US007117936B2

(12) United States Patent
Ohata et al.

(10) Patent No.: US 7,117,936 B2
(45) Date of Patent: Oct. 10, 2006

(54) TUBE FOR HEAT EXCHANGER

(75) Inventors: Hajime Ohata, Saitama (JP); Jun Akaike, Saitama (JP); Naoto Takayanagi, Saitama (JP); Shoji Akiyama, Saitama (JP); Yoshihisa Eto, Saitama (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 0 days.

(21) Appl. No.: 10/520,404

(22) PCT Filed: Jun. 25, 2003

(86) PCT No.: PCT/JP03/08018

§ 371 (c)(1),
(2), (4) Date: Jan. 6, 2005

(87) PCT Pub. No.: WO2004/005831

PCT Pub. Date: Jan. 15, 2004

(65) Prior Publication Data

US 2005/0247444 A1 Nov. 10, 2005

(30) Foreign Application Priority Data

Jul. 9, 2002 (JP) ..... 2002-199422

(51) Int. Cl.
*F28F 1/40* (2006.01)
*F28F 1/02* (2006.01)

(52) U.S. Cl. ..... 165/183; 165/177; 29/890.053

(58) Field of Classification Search ..... 165/177, 165/183

See application file for complete search history.

(56) References Cited

U.S. PATENT DOCUMENTS 2,757,628 A * 8/1956 Johnston ..... 29/890.047

(Continued)

FOREIGN PATENT DOCUMENTS

JP 10-088266 A 4/1998

(Continued)

OTHER PUBLICATIONS

International Search Report mailed on Oct. 14, 2003.

(Continued)

*Primary Examiner*—Allen J. Flanigan
(74) *Attorney, Agent, or Firm*—Rader, Fishman & Grauer PLLC

(57) ABSTRACT

In a tube (4) for a heat exchanger comprising a flat pipe (16) whose both ends are opened and in which a flow path (15) for a heat exchanging medium is formed, and an inner fin (17) arranged in the flow path (15), wherein said flat pipe (16) is constituted of a sheet of material for a flat pipe, the inner fin is constituted of two opposing flat plate portions (17*b*, 17*c*) connected along one of side edges of said flat pipe (16) and formed in a flat plate shape so as to be in contact with an inner surface of the said flat pipe (16), and projection portions (17*d*) which are projected from at least one of the flat plate portions (17*b*, 17*c*) and whose tops are in contact with the other opposing flat plate portion (17*b*, 17*c*). It is preferred that the projection portions (17*d*) are projected from both of the flat plate portions (17*b*, 17*c*) toward the opposing flat plate portion, and the opposing tops are made come in contact with each other. The tube for a heat exchanger which can prevent significant deformation of the inner fin from occurring when the inner fin included in the flat pipe is cut in a width direction thereof together with the flat pipe can be provided.

4 Claims, 10 Drawing Sheets

U.S. PATENT DOCUMENTS

| | | | | |
|---|---|---|---|---|
| 4,805,693 | A * | 2/1989 | Flessate | 165/153 |
| 5,185,925 | A * | 2/1993 | Ryan et al. | 29/890.049 |
| 5,979,051 | A * | 11/1999 | Kato et al. | 29/890.049 |
| 6,192,977 | B1 * | 2/2001 | Dey et al. | 165/177 |
| 6,241,012 | B1 * | 6/2001 | Yu et al. | 165/177 |
| 6,453,711 | B1 * | 9/2002 | Rhodes et al. | 72/180 |
| 6,640,886 | B1 * | 11/2003 | Lamich | 165/174 |

FOREIGN PATENT DOCUMENTS

| | | | |
|---|---|---|---|
| JP | 10-213389 | A | 8/1998 |
| JP | 11-148795 | A | 6/1999 |
| JP | 11-351777 | A | 12/1999 |
| JP | 2000-329488 | A | 11/2000 |
| JP | 2001-050677 | A | 2/2001 |

OTHER PUBLICATIONS

International Preliminary Examination Report mailed on Nov. 16, 2004.

* cited by examiner (a)

(b)

TUBE FOR HEAT EXCHANGER

This application is a U.S. National Phase Application under 35 USC 371 of International Application PCT/JP03/08018 filed on Jun. 25, 2003.

TECHNICAL FIELD

The present invention relates to tubes for a heat exchanger communicating between tanks of the heat exchanger and allowing heat exchange medium to flow, and especially relates to tubes each of which is formed by cutting a flat pipe and inner fin provided in the flat pipe at the forming of the flat pipe at the same time.

BACKGROUND ART

In recent air-conditioning units, it is considered to decrease volumetric flow of coolant in a refrigerating cycle to design a reduction of compressor's power as requirement for saving power and fuel efficiency. Thus, in a heat exchanger, it is desired to increase a heat exchanging efficiency so as to gain a heat exchanging ability more than of the prior heat exchanger in a less volumetric flow of coolant. Under thus condition, though coolant distribution in the heat exchanger influences on the heat exchanging efficiency largely, it is difficult to find an effective improvement plan for temperature distribution at the small volumetric flow due to the structure in a prior drawn cup type heat exchanger in which a tank is provided only in one side thereof. Therefore, the heat exchanger is in course of shifting from one side tank type of the heat exchanger to a both tank type heat exchanger which has tanks in both sides thereof these days.

Furthermore, there is a case that it is obliged to provide various incidental equipments around an air conditioning unit. In thus case, because minimization of the air conditioning unit is required, minimization of the heat exchanger is more necessary with this requirement. Accordingly, it becomes more important problem to secure the heat exchanging ability more than in prior heat exchangers with satisfying the requirement for minimization of the heat exchanger.

Though various improvements of the heat exchangers are considered from the above-mentioned point, above all, it is recognized as an effective means to improve a tube structure. About the improvement of the tube structure, it is desired to make an equivalent diameter of a flow path smaller as well as promoting flattening of the tube, and further it is considered as an effective means to provide inner fin in a flat pipe.

In the case of forming this tube, a flat pipe with a specific length is formed in advance and inner fin are inserted into the flat pipe and brazed so far. However, according to this method, there is disadvantage that productivity becomes worse because the inner fin must be inserted into every flat pipe.

Accordingly, this applicant adopts a method for producing tubes by a roll forming in order to resolve the above disadvantage. This is that a material for a flat pipe is rolled up so as to cover the inner fin, a flat pipe A is formed while including the inner fin B in the flat pipe as shown in FIG. 10, and then a tube D with a specific length is formed by inserting a cutting blade C from one side in a width direction thereof to cut the flat pipe A together with the inner fin B.

However, because a shape of a prior tube is determined only in a view point that the included inner fin makes an equivalent diameter of the flow path smaller, as shown in FIG. 10, there is a disadvantage that the inner fin B are deformed extremely and the flow path with small equivalent diameter can not be formed because the inner fin B get out of position in an arrow direction illustrated with a broken line (a width direction of the tube) by the cutting blade C when the cutting blade C inserted from the width direction in the case of forming the inner fin in, for instance, a corrugated shape.

It is considered that this disadvantage is caused by that stiffness to a width directional force of the inner fin itself, stiffness to a binding force by the flat pipe from a thickness direction thereof, and further a contact resistance to a width directional force at a contacting portion between the inner fin and the flat pipe are not secured because a shape of the inner fin is determined only in a view point that the equivalent diameter of the flow path is reduced.

Therefore, in this invention, it is a main object to provide tubes for a heat exchanger which can prevent much deformation of the inner fin to secure a flow path with a small equivalent diameter in the flat pipe in the case of cutting the inner fin included in the flat pipe together with the flat pipe in the width direction.

More concretely, the object of the invention is to provide tubes for a heat exchanger so as to increase the stiffness to the width directional force of the inner fin itself and the stiffness to the binding force by the flat pipe in the thickness direction thereof, and further to enlarge the contact resistance to a width directional force at a contacting portion between the inner fin and the flat pipe.

DISCLOSURE OF THE INVENTION

In order to achieve the above object, a tube for a heat exchanger according to the present invention has a flat pipe whose both ends are opened and in which a flow path for a heat exchanging medium is formed, and an inner fin provided in the flow path of the flat pipe, and which is constituted of a sheet of a material for a flat pipe, and is characterized in that the inner fin is constituted of two opposing flat plate portions connected along one of side edges of the flat pipe and is formed in a flat plate shape so as to be in contact with the inner surface of the flat pipe, and projection portions which project from at least one of the flat plate portions and whose tops are in contact with the other opposing flat plate portion.

Accordingly, because the inner fin including in the flat pipe is that two opposing flat plate portions are in contact with the inner surfaces of the flat pipe, it is possible to increase the stiffness to the width directional force of the inner fin itself and the contact resistance to the width directional force at the contact portion between the inner fin and the flat pipe, and further because the projection portions in contact with the inner surface of the opposing flat plate are formed in at least one of the flat plates, it is possible to increase the stiffness to the binding force by the flat pipe in the thickness direction, as a result, it is possible to prevent the disadvantage such that significant deformation of the inner fin is occurred at the time of cutting the flat pipe.

Besides, a tube for a heat exchanger according to the present invention has a flat pipe whose both ends are opened and in which a flow path for a heat exchanging medium is formed, and an inner fin provided in the flow path of the flat pipe, and which is constituted of a sheet of a material for a flat pipe, wherein the inner fin may be constituted of two opposing flat plate portions connected along one of side edges of the flat pipe and is formed in a flat plate shape so as to be in contact with the inner surface of the flat pipe, and projection portions which project from both flat plate portions toward the opposing flat plate portion and the opposing tops of which are made come into contact with each other.

Accordingly, in thus constitution, because two opposing flat plate portions are in contact with the inner surface of the flat pipe, it is possible to increase the stiffness to the width directional force of the inner fin itself and the contact resistance to the width directional force at the contact portion between the inner fin and the flat pipe, and further because the tops of the projection portions which are projected from one of the both flat plates to the opposing flat plate are in contact with one anther, it is possible to increase the stiffness to the binding force by the flat pipe in the thickness direction, as a result, it is possible to prevent the disadvantage such that significant deformation of the inner fin is occurred at the time of cutting the flat pipe.

The projection portions may be constituted of folded portions which are folded so as to abut, and the tops of them may be formed flatly. Besides, a cross sectional shape of the projection portion may be formed so as to focus against the top portion thereof.

The above mentioned tube has a constitution available to a case of forming by involving the inner fin in the flat pipe at the time of forming the plate pipe and making the flat plates of it be in contact with inner surface of the flat pipe, and cutting the flat pipe with the inner fin.

Besides, it is preferred when a saving-thickness of the tube is designed that the above mentioned flat pipe and inner fin are bonded by a brazing material cladded on the inner fin. Furthermore, it is preferred when corrosion proof of the tube is increased that a sacrificial erosion layer is cladded on an outer surface of the flat pipe. Moreover, it is preferred when flow resistance of the flow path is decreased that the inner fin is formed thinner than thickness of the flat pipe.

BEST MODE FOR CARRYING OUT THE INVENTION

Figure 1:
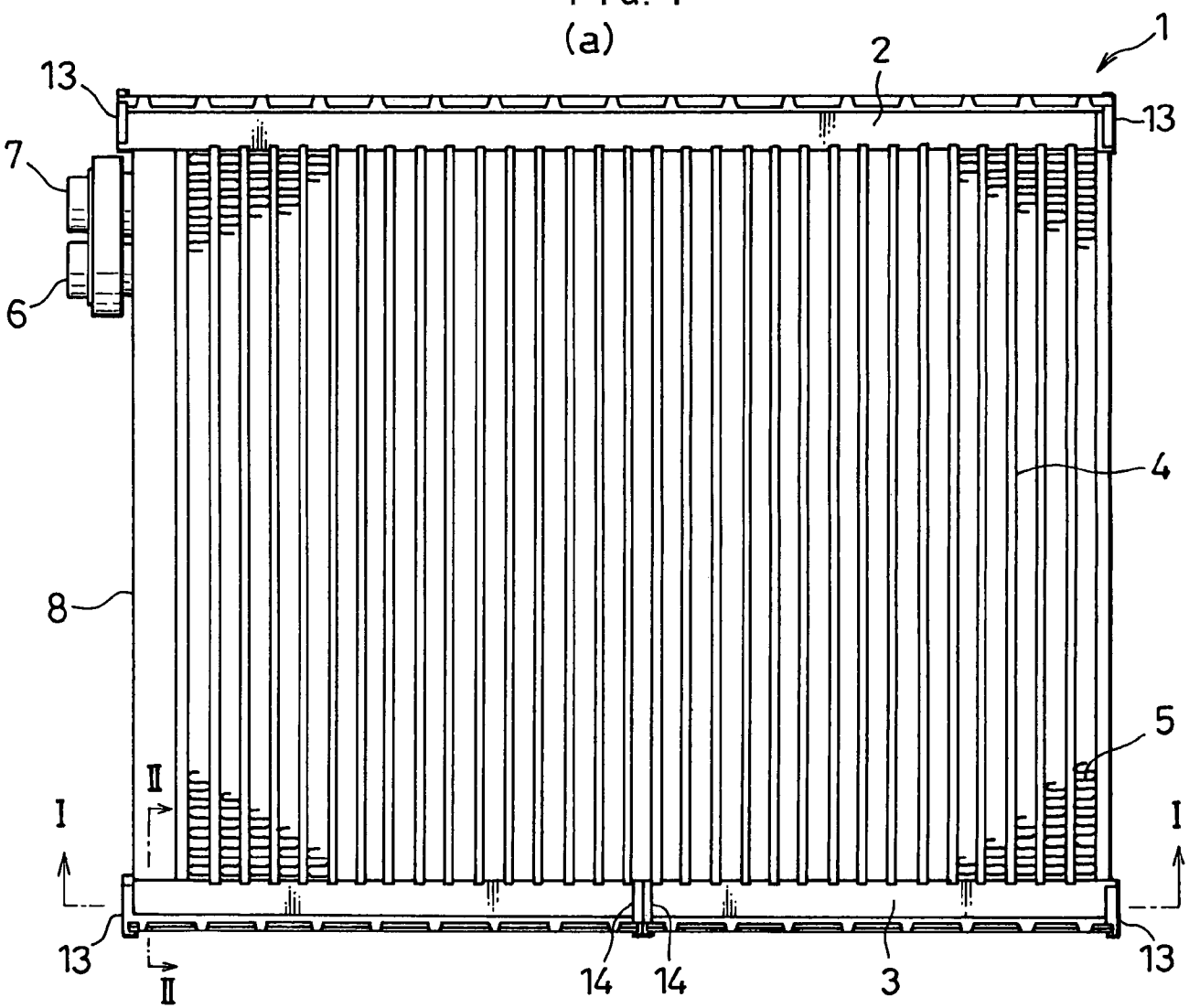
FIG. 1 illustrates a constitutional example of a heat exchanger using tubes according to the present invention, (a) is a front view thereof, and (b) is a side view shown from a side on which an intake and outlet of coolant are provided.
Figure 1:
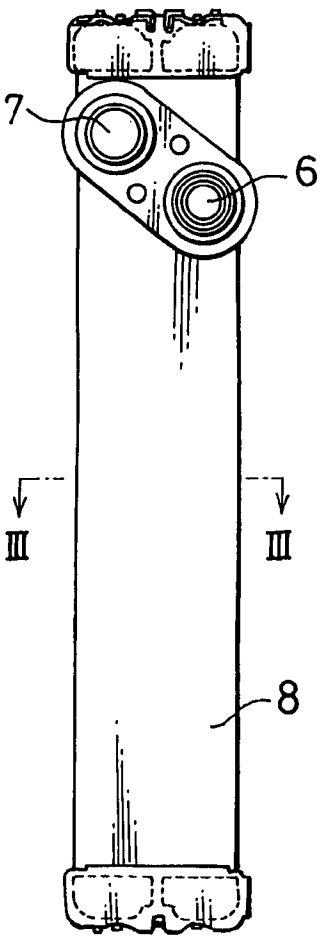
Figure 2:
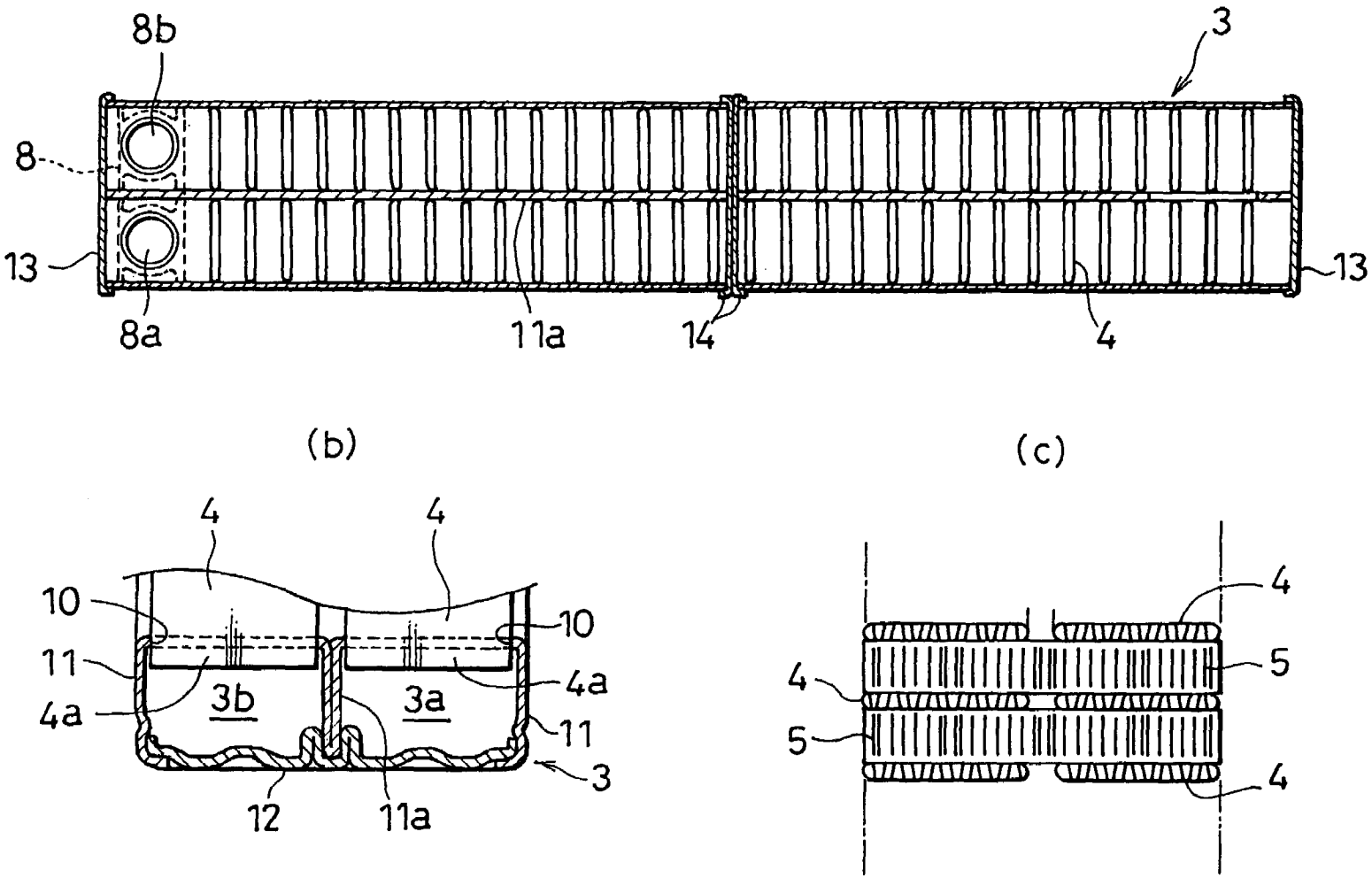
FIG. 2 is a diagram showing each part of the heat exchanger shown in FIG. 1, FIG. 2 (*a*) is a cross sectional view cut by a I—I line in FIG. 1 (*a*), FIG. 2 (*b*) is a cross sectional view cut by a II—II line in FIG. 1(*a*), and FIG. 2 (*c*) is a cross sectional view cut by a III—III line in FIG. 1 (*b*).

Hereinafter, a working mode of the present invention is explained due to drawings. In FIGS. 1 and 2, a heat exchanger 1 is, for instance, to be used as an evaporator constituting a part of a refrigerating cycle, and provided with a pair of tanks 2, 3, a plurality of flat tubes 4 communicating between the pair of tanks 2, 3, corrugated fins 5 inserted and connected between the tubes 4 and an intake 6 and outlet 7 of coolant, and constituted by having a side tank 8 communicating with the tank.

Hereinafter explaining about one of the tanks 3 because the tanks 2, 3 are located so as to face to each other with a specific distance and they have a basically similar structure except for a structure in middle portions thereof. The tank 3 is, as shown in FIG. 2 (*b*), constituted of an end plate 11 in that tube insertion holes 10 in each of which an opening end portion 4*a* of the flat tube 4 is inserted and connected are formed, a tank plate 12 engaging with the end plate 11 and constituting a cylindrical body together with the end plate 11, and caps 13 which blockades opening end portions of the cylindrical body constituted of the end plate 11 and the tank plate 12. An inner portion of the tank 3 is divided to tank spaces 3*a*, 3*b* in front and behind in a ventilation direction (a width direction) by a partition plate 11 which is formed unitedly to the end plate 11 and extends in a laminating direction.

Besides, the inner portions of the tanks 2, 3 are divided at specific positions in the laminating direction according to a number of passes of heat exchanging medium. In this embodiment, the lower tank 3 is divided in a middle of the laminating direction and a cap 14 is arranged in the divided portion, so that four-pass type heat exchanger that the heat exchanging medium is flown four times between the tanks as a whole is constituted.

The side tank 8 is formed together with an inflow passage 8*a* and an outflow passage 8*b* unitedly by extrusion and connected with each of the end plate 11 of the tanks 2, 3. The inflow passage 8*a* is connected with a tank portion locating at an upper stream side and the outflow passage 8*b* is connected with a tank portion located at a downstream side according to the number of passes. In the four-pass type heat exchanger shown in this embodiment, the inflow passage 8*a* is communicated with one tank space 3*a* of the tank 3 and the outflow passage 8*b* is communicated with another tank space 3*b* of the tank 3.

Accordingly, coolant transferred from an expansion valve not shown in figures is flown into an upper stream portion of the tank 3 via the side tank 8 and moved between the tanks 2, 3 via the flat tubes 4, exchanging heat with an air passing through the fins 5 in this process. And then, the coolant is flown out of a downstream portion of the tank 3 via the side tank 8 finally.

Figure 3:
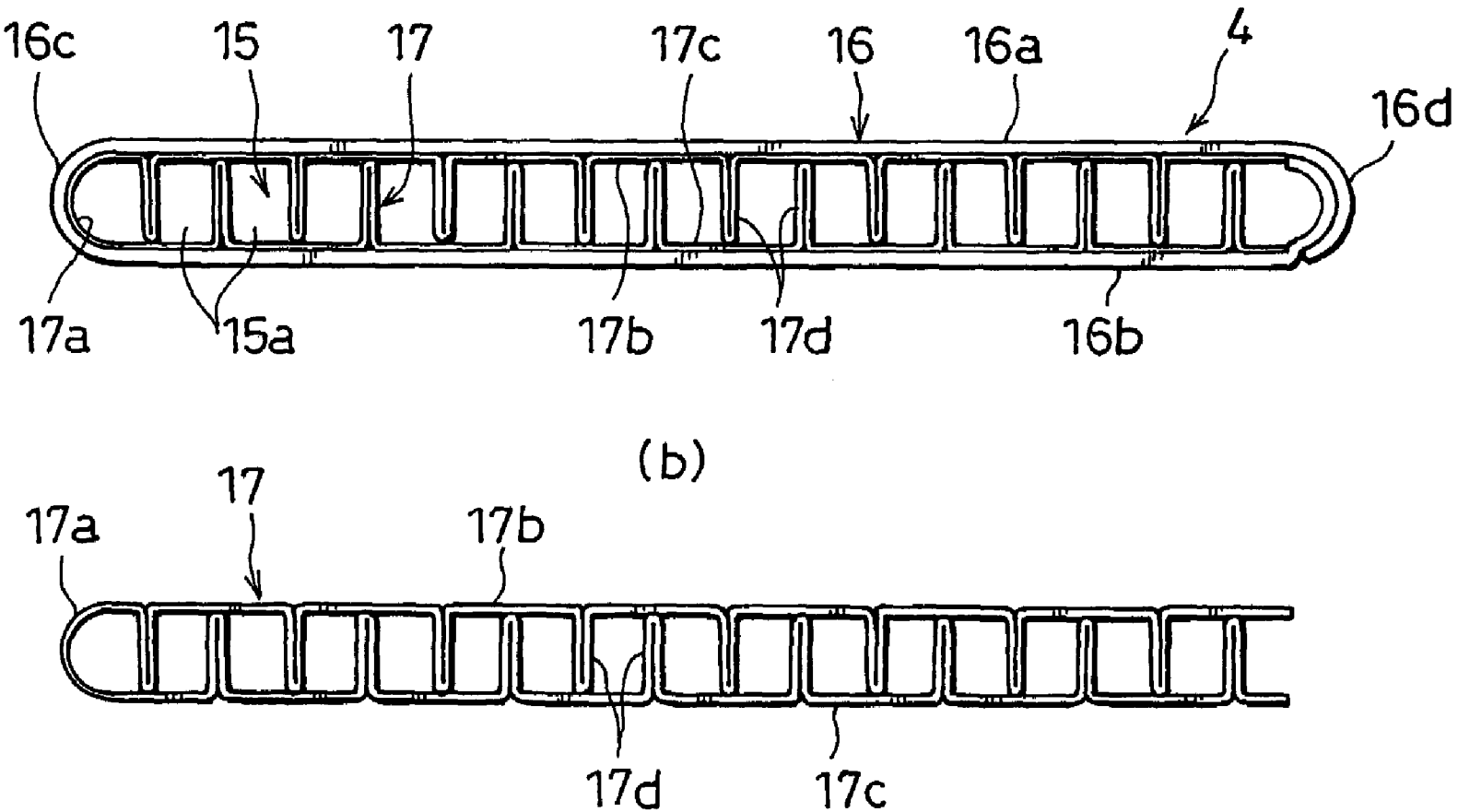
FIG. 3 (*a*) is a cross sectional view showing a tube structure example which is constituted by involving the inner fin to the flat pipe before cutting, and FIG. 3 (*b*) is a cross sectional view showing an inner fin used in the tube in FIG. 3 (*a*).

Each of the flat tube 4 is that both ends inserted into the tanks 2, 3 is opened, as shown in FIG. 3, and is constituted by housing an inner fin 17 in a flat pipe 16 in which a path 15 for heat exchanging medium is formed. The flat pipe 16 is formed by a roll forming from a sheet of a material for flat pipe constituted by a metal with good heat conduction such as aluminum, wherein flat portions 16*a*, 16*b* facing each other are formed. In this embodiment, the material for flat pipe is doubled in an axis along a longitudinal direction thereof, a bending portion 16*c* is formed at one end in a width direction thereof, and a connected tab 16*d* is formed at another end in the width direction.

The inner fin 17 included in the flat pipe 16 is constituted of a connecting portion 17*a* formed along one of side edges of the flat pipe 16, both flat plate portions 17*b*, 17*c* formed in a flat shape and facing each other which are connected each other via the connecting portion 17*a* and are in contact with inner surfaces of the flat portions 16*a*, 16*b*, projection portions 17*d* each of which is projected from one of the flat plate portions 17*b*, 17*c* to the other of the flat plate portions 17*b*, 17*c* and whose tops are in contact with an inner surface of the opposing flat plate portion.

In this embodiment, each of the flat plate portions 17*b*, 17*c* is formed in the approximately same width as the path 15, and each of the projection portions 17*d* is constituted of a folded portion which is folded so as to come into contact. The projection portions 17*d* are formed in plural at specific intervals in both flat plate portions 17*b*, 17*c*, wherein each of tops is in contact with an inner surface (an opposite surface to a side which the inner surface of the flat pipe 16 is in contact with) of the opposite flat plate portion 17*b*, 17*c*, so that the path 15 in the flat pipe is divided into a plurality of small flow paths 15*a* whose equivalent diameters are small.

Besides, the inner fin 17 used here is that brazing material is claded on both sides thereof and the inner fin 17 is set thinner than thickness of the flat pipe 16. Furthermore, a sacrificial layer is provided on an outer surface of the flat pipe 16 in order to increase a corrosion proof. Note that it is possible that the inner fin is made of a bare material owing to using capillarity arising at the time of melting brazing material of the tank.

Figure 4:
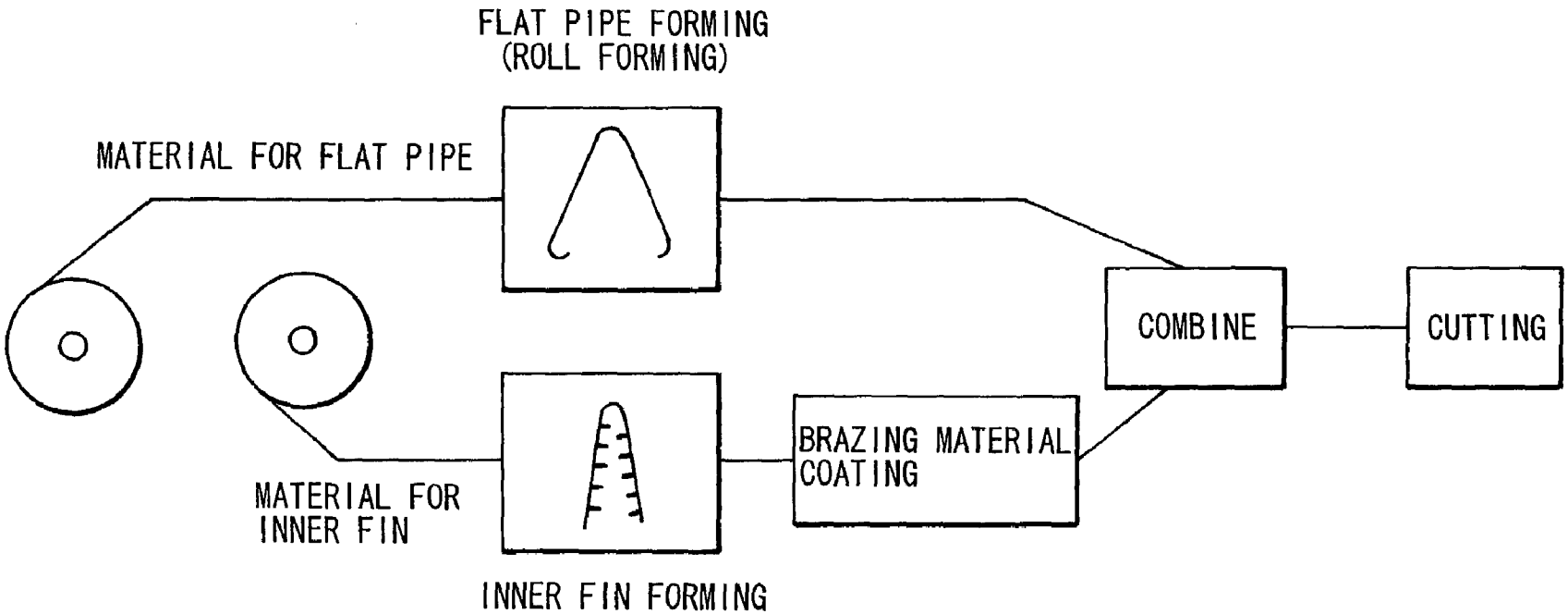
FIG. 4 is a diagram showing a forming process of a flat tube.

The flat tube 4 formed thus is, as shown in a forming process example in FIG. 4, formed by involving the inner fin 17 shown in FIG. 3 (*b*) which is formed another process so as to cover the inner fin 17 with the material for flat pipe on the way of the process for forming the flat pipe 16 by the roll forming, namely in the process for forming in a tube shape by folding so as to roll up the material for flat pipe, and cutting the flat pipe 16 together with the inner fin 17 at a specific length. Then, the cut flat pipes 16 are installed to the tube insertion holes 10 of the tanks 2, 3 and the fins are inserted between the tubes to assemble as a heat exchanger, and the assembled heat exchanger is fixed by jigs as a whole and inserted into a furnace, so that the connected tabs 16*d* of the plat pipe 16 are brazed and the inner fins 17 are brazed on inner surfaces of the flat pipes 16 by brazing materials claded on the inner fins 17 themselves, respectively.

In the above mentioned structure, in the cutting process before brazing, though the tubes are in a condition such as to be held from outside thereof and force is applied to the inner fin 17 in a width direction of the tube 4 by inserting the cutting blade, the stiffness to the force in the width direction of the inner fin itself can be increased because each of the inner fins has two flat plate portions 17*b*, 17*c* opposing each other which are connected via the connecting portion 17*a*, and it is possible that contact resistance at contact portions between the inner fin 17 and the flat pipe 16 becomes large because the flat plate portions 17*b*, 17*c* are in contact with the inner surface of the flat pipe 16 in a surface contact. Moreover, because each top of the projection portions 17*d* formed on each of the flat plate portions 17*b*, 17*c* comes in contact with the inner surface of the opposite flat plate portion, stiffness in a thickness direction of the flat pipe 16 can be increased. Therefore, disadvantage that the inner fin 17 is deformed extremely so as to shift the inner fin 17 largely in the width direction can be decreased and it is possible to secure a plurality of the small flow paths 15*a* whose equivalent diameters are small in the flat pipe.

Figure 5:
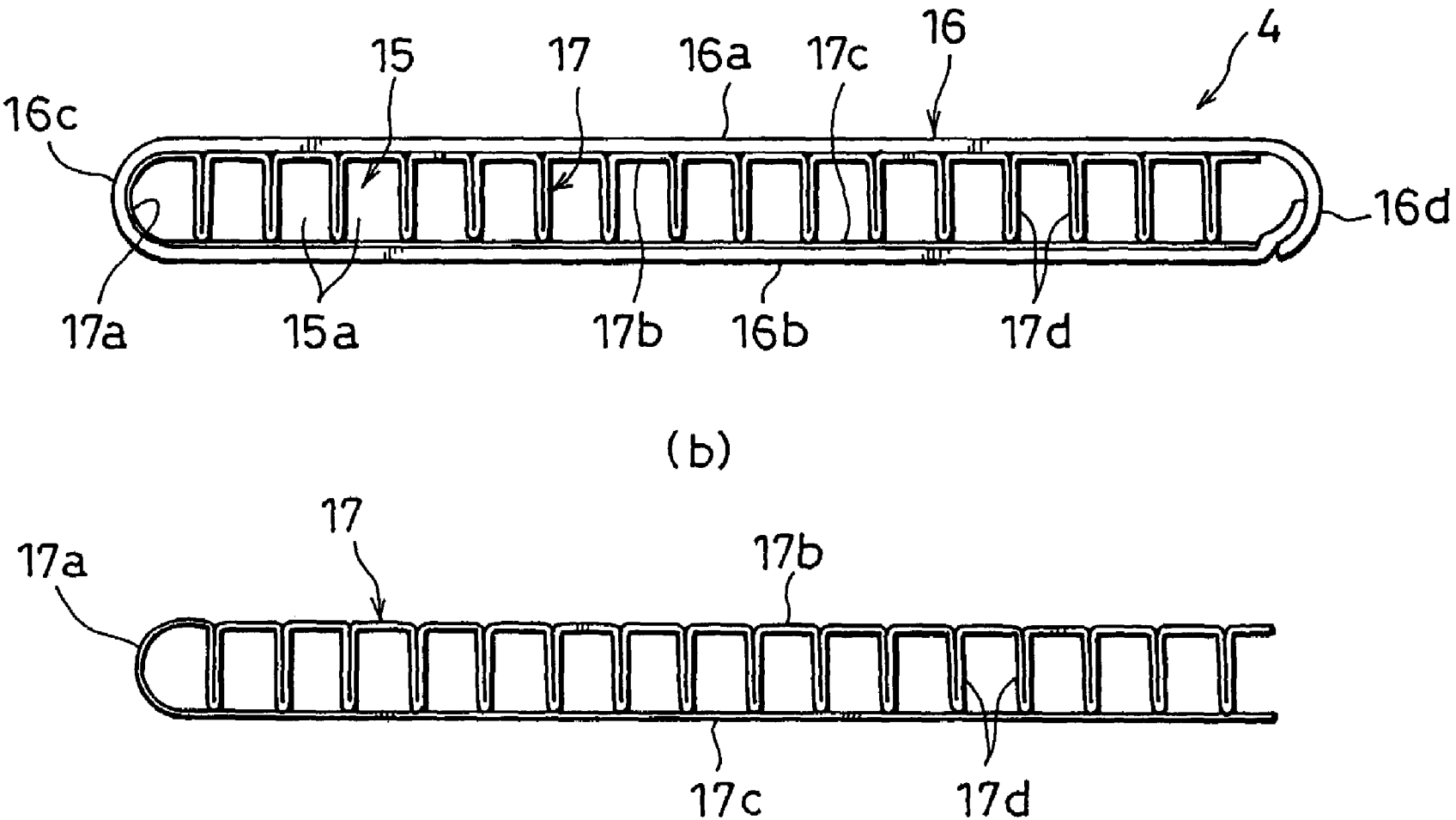
FIG. 5 (*a*) is a cross sectional view showing an improved example of FIG. 3 (*a*) and showing a tube before cutting, and FIG. 5 (*b*) is a cross sectional view showing an inner fin using in the tube in FIG. 5 (*a*).

Another embodiment of the inner fin 17 included in the above flat pipe 16 is shown in FIG. 5. This inner fin 17 is constituted so that the projection portions 17*d* are formed only in one of the flat plate portions 17*b*, another of the flat plate portions 17*c* is constituted of a continuous flat surface in contact with the flat portion 16*b* of the flat pipe 16, and the top of each projection portion 17*d* is in contact with the inner surface (a opposite surface to the side which the inner surface of the flat pipe 16 is in contact with) of the flat plate portion 17*c*. The projection portions 17*d* used in this embodiment are formed in the flat plate portion 17*b* at a specific pitch which is an approximately half pitch in the projection portions 17*d* formed in the flat plate portions 17*b*, 17*c* in the aforementioned structure so as to make an equivalent diameter of the small flow path 15*a* approximately similar to the aforementioned structure example.

Also in thus structure, two flat plate portions 17*b*, 17*c* facing each other and connected via the connecting portion 17*a* are in contact with the inner surface of the flat pipe 16 by a surface contact, so that the stiffness to the force in the width direction of the inner fin itself can be increased and the contact resistance at the contact portion between the inner fin 17 and the flat pipe 16 can be enlarged. Accordingly, also in this embodiment, disadvantage that the inner fin 17 is deformed extremely so as to shift the inner fin 17 largely in the width direction can be decreased and it is possible to secure a plurality of the small flow paths 15*a* whose equivalent diameters are small in the flat pipe.

Figure 6:
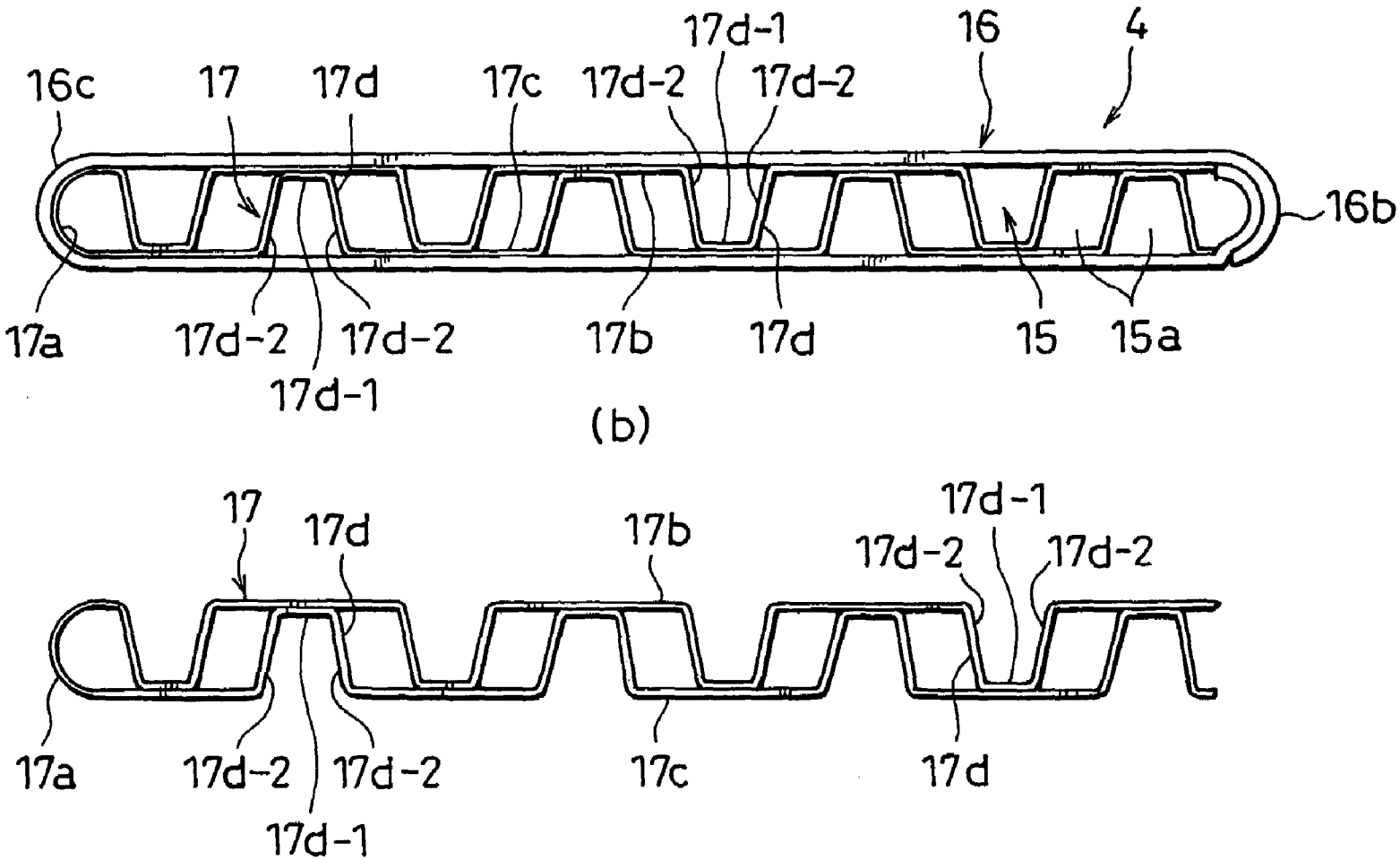
FIG. 6 (*a*) is a cross sectional view showing another tube structure example constituted by involving an inner fin in the flat pipe, and FIG. 6 (*b*) is a cross sectional view showing an inner fin used in the tube in FIG. 6 (*a*).

The other structure example of the inner fin 17 included in the aforementioned flat pipe 16 is shown in FIG. 6. In this inner fin 17, each of the projection portions 17*d* is formed in a trapezoidal shape in a cross sectional view by a top portion 17*d*-1 formed flatly and constructing portions 17*d*-2 constructing between the top portion 17*d*-1 and the flat plate portion (17*b* or 17*c*). In this embodiment, the projection portions are formed in both of the flat plate portions 17*b*, 17*c* in plural at specific intervals, and each top of them is in contact with the inner surface (a opposite surface to the side which the inner surface of the flat pipe 16 is in contact with) of the flat plate portion opposing thereto so as to divide the flow path 15 to a plurality of small flow paths 15*a* whose equivalent diameters are small. Note that the other components are similar to ones of the aforementioned structure examples, so that the explanation is omitted by marking the same reference number to the same parts respectively.

In thus structure, two flat plate portions 17*b*, 17*c* facing each other and connected via the connecting portion 17*a* are in contact with the inner surface of the flat pipe 16 by a surface contact, so that the stiffness to the force in the width direction of the inner fin itself can be increased and the contact resistance at the contact portion between the inner fin 17 and the flat pipe 16 can be enlarged. Furthermore, because the tops 17*d*-1 of the projection portions 17*d* are formed in a flat shape and are in contact with the inner surface of the opposite flat plate portion, the contact resistance between the projection portions 17*d* and the flat plate portions 17*b*, 17*c* can be enlarged, and the stiffness to the force in the thickness direction of the flat pipe can be increased. Accordingly, disadvantage that the inner fin 17 is deformed extremely so as to shift the inner fin 17 largely in the width direction can be decreased and it is possible to secure a plurality of the small flow paths 15*a* whose equivalent diameters are small in the flat pipe. Besides, in the aforementioned shape, the contact resistance is large at a contact portion between each of the projection portions of the inner fin and the flat portion, so that cutting that deformation is small can be achieved even if the connecting portion of the inner fin is not in contact with the inner surface of the flat pipe.

Besides, the aforementioned constructing portion 17*d*-2 is preferred that an angle of inclination thereof to the flat plate portion 17*b*, 17*c* is set within a range of 45°–90° since cutting of inner fin 17 is facilitated and it is necessary to secure the equivalent path with a small equivalent diameter, the aforementioned constructing portion 17*d*-2, and the equivalent diameter of each small flow path 15*a* defined by the inner fin 17 is set within a range of 0.7 mm–1.5 mm when height of the tube is set within a range of 1.5 mm–2.3 mm, thickness of the flat pipe is set within a range of 0.15 mm–0.25 mm, and plate thickness of the inner fin is set within a range of 0.06 mm–0.13 mm. According to setting the angle of inclination in the constructing portions 17*d*-2 within the above range, the stiffness of the constructing portions 17*d*-2 of the inner fin 17 is secured, so that the cutting by the cutting blade becomes easy.

Figure 7:
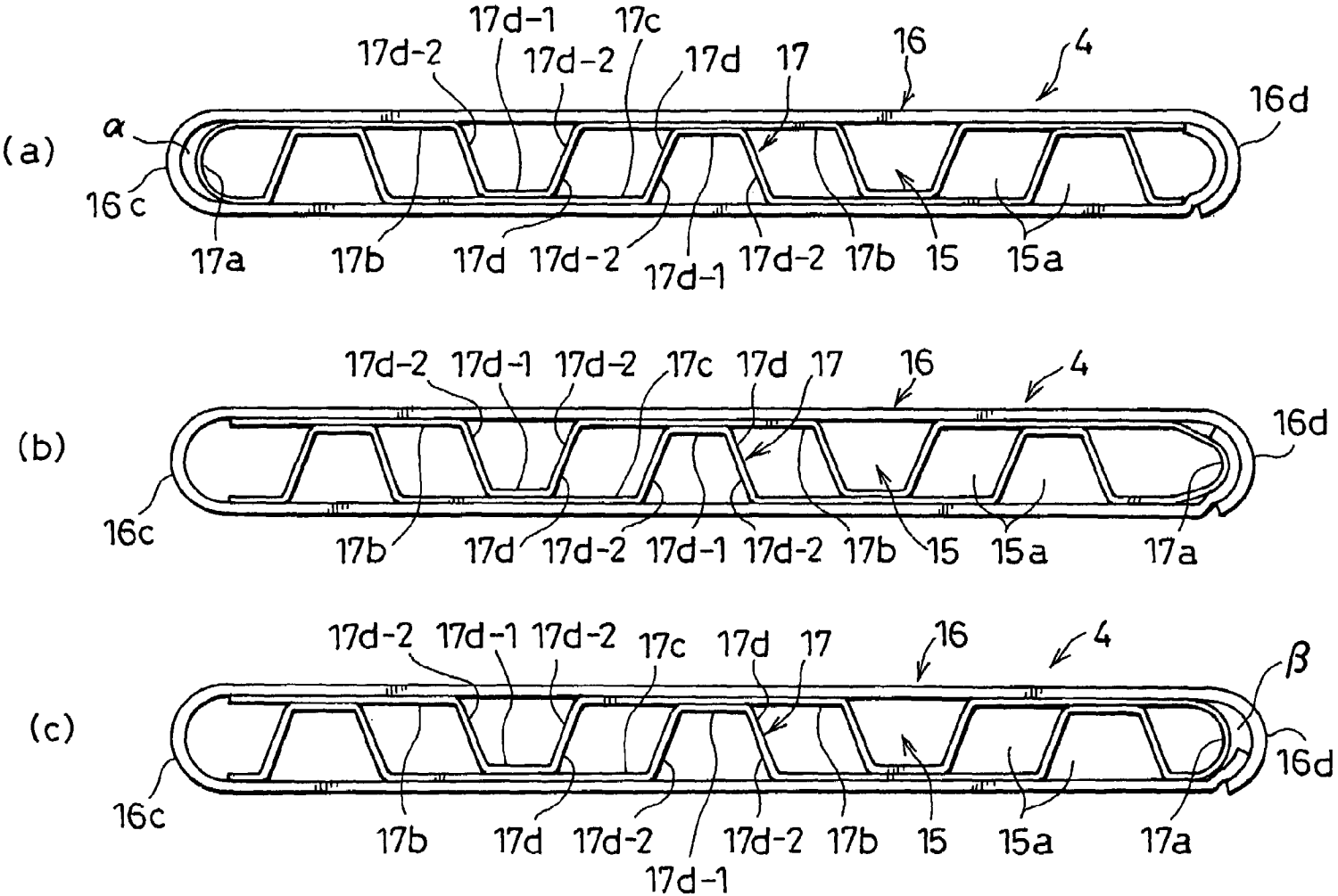
FIG. 7 is a diagram showing an improved example of FIG. 6 (*a*), FIG. 7 (*a*) is a diagram showing a condition that a gap $\alpha$ is formed between a folded portion 16*c* of the flat pipe and a connecting portion 17*a*, FIG. 7 (*b*) is a diagram showing an example that a side of a connected tab 16*d* of the flat pipe faces to a connecting portion 17*a* and the connected tab 16*d* is in contact with the connecting portion 17*a*, and FIG. 7 (*c*) is a diagram showing an example that a side of a connected tab 16*d* of the flat pipe faces to a connecting portion 17*a* and a gap $\beta$ is formed between the connected tab 16*d* and the connecting portion 17*a*.

Moreover, in the aforementioned structure, improvement as shown in FIG. 7 may be adopted. Namely, though the structure shown in FIG. 6 is that a folding portion 16*c* in the flat pipe 16 of the tube 4 is in contact with the connecting portion 17*a* of the inner fins 17, a gap (a) may be formed between the folding portion 16*c* and the connecting portion 17*a* so as to form a play between them. It is confirmed that bad brazing in the inner fin is hard to occur rather than the above structure example that the folding portion 16*c* is in contact with the connecting portion 17*a*.

Furthermore, in the aforementioned structure, the inner fin 17 is housed in the flat pipe 16 so as to oppose the folding portion 16*c* of the flat pipe 16 to the connecting portion 17*a* of the inner fin 17, but the inner fin 17 may be housed so as to oppose the connected tab 16*d* of the flat pipe 16 to the connecting portion 17*a* of the inner fin 17 by reversing the inner fin 17. Namely, the inner fin 17 may be housed so that the connecting portion 17*a* comes in contact with the connected tab 16*d*, or so that a gap (β) is formed between the connected tab 16*d* and the connecting portion 17*a* to form a play between them. In thus structure, it is confirmed that bad brazing in the inner fin is hard to occur.

Figure 8:
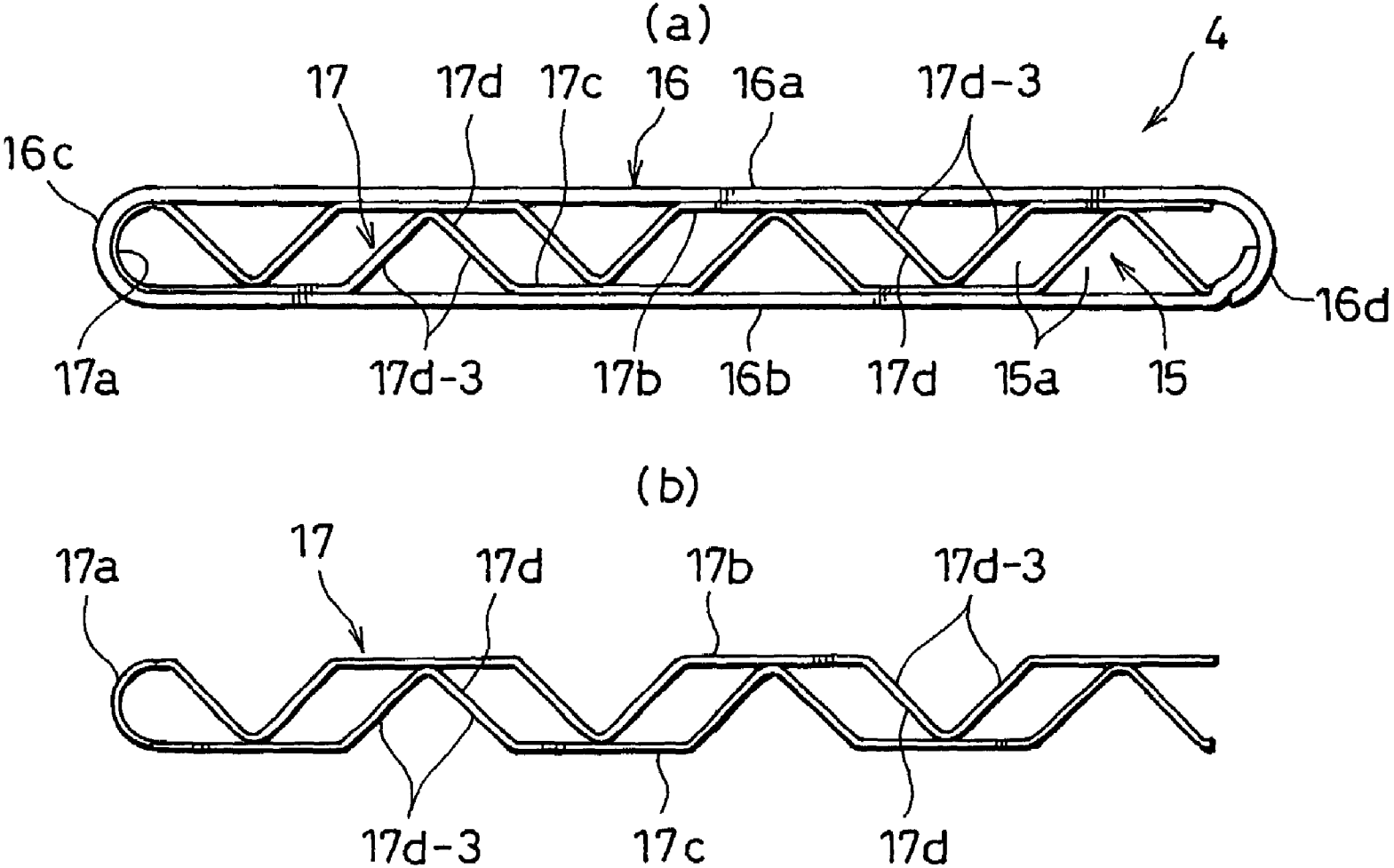
FIG. 8 (*a*) is a cross sectional view illustrating a tube before cutting showing an improved example of FIG. 6 (*a*), and FIG. 8 (*b*) is a cross sectional view showing an inner fin used in the tube in FIG. 8 (*a*).

FIG. 8 shows the other improvement of the inner fin 17 shown in FIG. 6 which is included in the flat pipe 16. In this inner fin 17, the projection portion 17*d* has a cross-sectional shape so as to focus against a top thereof, namely is formed in a triangle shape in a cross section such that tops of both constructing portions 17*d*-3 inclining to the flat plate portions are abutted each other in this example. Thus projection portions 17*d* are also formed in both flat plate portions 17*b*, 17*c* in plural at a specific intervals, and each top of them is in contact with the inner surface (a opposite surface to the side which the inner surface of the flat pipe 16 is in contact with) of the flat plate portion opposing thereto so as to divide the flow path 15 to a plurality of small flow paths 15*a* whose equivalent diameters are small. Note that the other components are similar to ones of the aforementioned structure examples, so that the explanation is omitted by marking the same reference number to the same parts respectively.

Accordingly, also in this example, two flat plate portions 17*b*, 17*c* facing each other and connected via the connecting portion 17*a* are in contact with the inner surface of the flat pipe 16 by a surface contact, so that the stiffness to the force in the width direction of the inner fin itself can be increased and the contact resistance at the contact portion between the inner fin 17 and the flat pipe 16 can be enlarged. Because the tops of the projection portions 17*d* are in contact with the inner surface of the opposite flat plate portion, the stiffness to the force in the thickness direction of the flat pipe can be increased. Therefore, disadvantage that the inner fin 17 is deformed extremely so as to shift the inner fin 17 largely in the width direction can be decreased and it is possible to secure a plurality of the small flow paths 15*a* whose equivalent diameters are small in the flat pipe.

Figure 9:
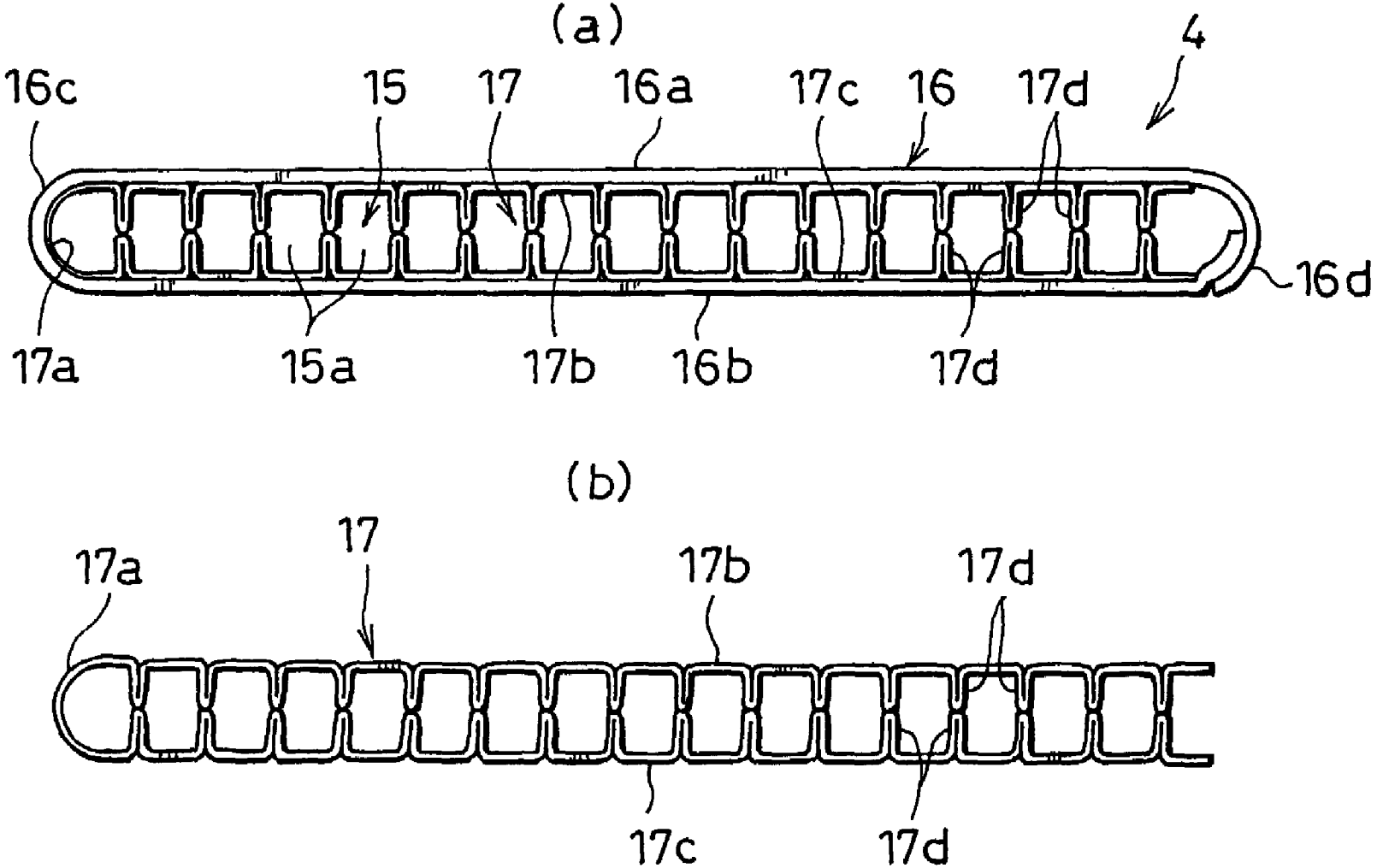
FIG. 9 (*a*) is a cross sectional view illustrating an another tube structure example before cutting which is constituted by involving an inner fin into the flat pipe, and FIG. 9 (*b*) is a cross sectional view showing the inner fin used in the tube.
Figure 10:
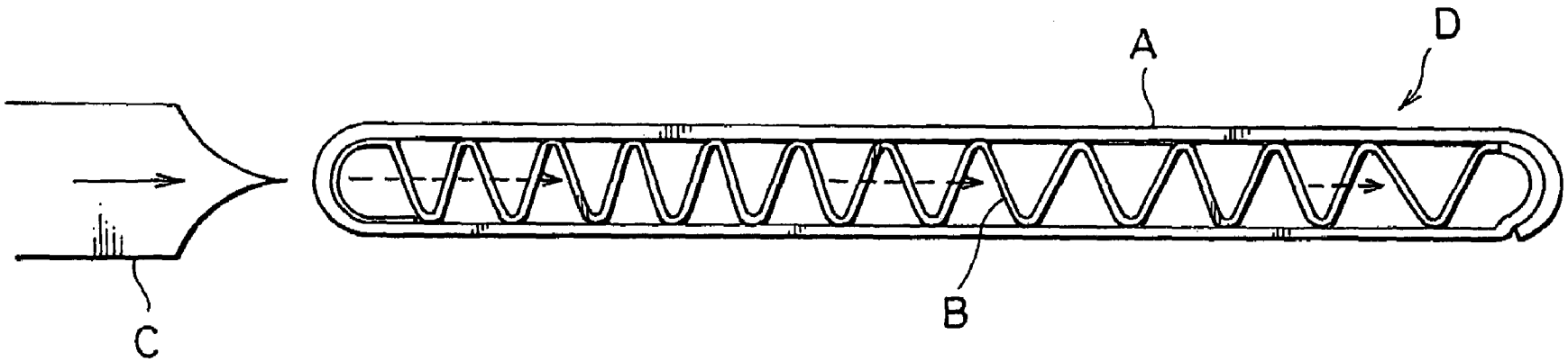
FIG. 10 is a diagram illustrating a method such as to cut the prior forming tube by a cutting blade C.

Another improvement of the inner fin 17 is shown in FIG. 9. In this inner fin 17, projection portions 17*d* are formed from both flat plate portions 17*b*, 17*c* to the opposite flat plate portions respectively and the tops of the projection portions 17*d* are in contact with the tops opposite thereto. In this embodiment, the projection portions 17*d* are formed by folding portions which are folded so as to be in contact with one another and the tops which face one another are in contact with one another, so that the flow path 15 is divided to a plurality of small flow paths 15*a* with small equivalent diameters respectively. Note that the other components are similar to ones of the aforementioned structure examples, so that the explanation is omitted by marking the same reference number to the same parts respectively.

Accordingly, in thus structure, two flat plate portions 17*b*, 17*c* facing each other and connected via the connecting portion 17*a* are in contact with the inner surface of the flat pipe 16 by a surface contact, so that the stiffness to the force in the width direction of the inner fin itself can be increased and the contact resistance at the contact portion between the inner fin 17 and the flat pipe 16 can be enlarged. Because the tops of the projection portions 17*d* are in contact with the inner surface of the opposite flat plate portion, the stiffness to the force in the thickness direction of the flat pipe can be increased. Therefore, disadvantage that the inner fin 17 is deformed extremely so as to shift the inner fin 17 largely in the width direction can be decreased and it is possible to secure a plurality of the small flow paths 15*a* whose equivalent diameters are small in the flat pipe.

Besides, in the structure shown in FIG. 9, though the example that abutted projection portions are constituted of the folding portions is shown, if the small flow paths with available equivalent diameters can be formed, each projection portion may be made in the approximately trapezoidal shape in a cross section as shown in FIG. 6, or may be made in the approximately triangle shape in a cross section as shown in FIG. 8, and further the tops which face one another may be abutted.

INDUSTRIAL APPLICABILITY

As above mentioned, according to this invention, because an inner fin arranged in a flow path of a flat pipe is constituted of two opposite flat plate portions formed in a flat plate shape so as to be connected along one of side edges of the flat pipe and be in contact with an inner surface of the flat plate portion, and projection portions which project from at least one of the flat plate portions and whose tops are in contact with another of the opposite flat plate portions, or constituted of two opposite flat plate portions formed in a flat plate shape so as to be connected along one of side edges of the flat pipe and be in contact with an inner surface of the flat plate portion, and projection portions which project from both of the flat plate portions and whose tops are in contact with one another, stiffness to a force in a width direction of the inner fin, the contact resistance to the force in the width direction at a contact portion between the inner fin and the flat pipe, and further stiffness to restricting force in a thickness direction by the flat pipe can be increased, as a result, in the case of cutting the flat pipe in the condition that the inner fin is included, it is possible to be hard to shift the inner fin and it is possible to secure a plurality of paths, whose equivalent diameters are small, in the flat pipe.

The invention claimed is:

1. A tube for a heat exchanger constituted of a flat pipe whose both ends are opened and in which a flow path for a heat exchanging medium and an inner fin arranged in said flow path of the flat pipe and formed separately from said flat pipe thinner than a thickness of said flat pipe, wherein said flat pipe is constituted by a sheet of material for a flat pipe, characterized in that:

said inner fin is constituted of two opposing flat plate portions connected along one of side edges of said flat pipe and formed in a flat plate shape so as to be in contact with an inner surface of said flat pipe, and projection portions which are projected from at least one of the flat plate portions and whose tops are in contact with the other opposing flat plate portion, and said tube is formed by cutting said flat pipe together with said inner fin.

2. A tube for a heat exchanger according to claim 1, characterized in that each top of said projection portions is formed flatly.

3. A tube for a heat exchanger according to claim 1, characterized in that each of said projection portions has a shape in a cross section such as to focus against the top thereof.

4. A tube for a heat exchanger according to claim 1, 2 or 3, characterized in that said flat pipe and said inner fin are brazed by a brazing material cladded on said inner fin.

* * * * *